United States Patent [19]

Hibbard

[11] 4,319,985

[45] Mar. 16, 1982

[54] GOLD CONCENTRATOR

[75] Inventor: William M. Hibbard, McCall, Id.

[73] Assignee: His Way, McCall, Id.

[21] Appl. No.: 218,977

[22] Filed: Dec. 22, 1980

[51] Int. Cl.[3] ..... B03B 5/26

[52] U.S. Cl. ..... 209/3; 209/44; 209/458

[58] Field of Search ..... 209/3, 13, 14, 18, 43, 209/44, 437, 441, 443, 458, 460

[56] References Cited

U.S. PATENT DOCUMENTS

| | | | |
|---|---|---|---|
| 219,926 | 9/1879 | Eddy | 209/458 |
| 539,990 | 5/1895 | Grant | 209/437 |
| 815,853 | 3/1906 | Mitchell | 209/437 |
| 1,129,351 | 2/1915 | Lake | 209/14 X |
| 1,488,997 | 4/1924 | McMurphy | 209/44 |
| 1,915,602 | 6/1933 | Goody | 209/44 X |
| 2,049,962 | 8/1936 | Lamberson | 209/44 |
| 2,184,594 | 12/1939 | Hoyois | 209/460 |
| 2,380,881 | 7/1945 | Trostler et al. | 209/44 X |
| 2,773,594 | 12/1956 | Tyer | 209/13 |
| 2,864,501 | 12/1958 | Bolander | 209/470 |
| 3,040,885 | 6/1962 | Bruneau | 209/14 |
| 3,232,426 | 2/1966 | Caparrella et al. | 209/44 |
| 3,909,398 | 9/1975 | Leonard | 209/458 X |
| 3,941,690 | 3/1976 | Powers et al. | 209/44 X |
| 4,076,614 | 2/1978 | Todd | 209/13 |

*Primary Examiner*—Ralph J. Hill

*Attorney, Agent, or Firm*—Sughrue, Mion, Zinn, Macpeak & Seas

[57] ABSTRACT

A gold concentrator comprises a housing at the end of a sluice into which a quantity of sand, rock and gold particles is deposited. A screen on a portion of the sluice serves to segregate larger particles of rock and gold from the finer sand particles. A hose is attached to the rear wall of the housing and water under pressure mixes with the finer sand. The mixture of sand and water strikes a wall and a depending flange within the housing causing the mixture to turn over therein thus creating a suspension of particles within the liquid. The suspension falls onto the sluice and flows downwardly therealong and over the screen at the bottom thereof. A flange at the end of the sluice turns the suspension in the opposite direction where it flows down a forwardly extending second sluice. The forwardly extending second sluice has a rubber mat thereon having a series of transversely extending grooves which function to trap the gold and black sand particles therein. The screen serves to retard the flow of suspension mixture as it advances down the sluice and to remove large particles of rock, gold and silver in the suspension.

12 Claims, 4 Drawing Figures

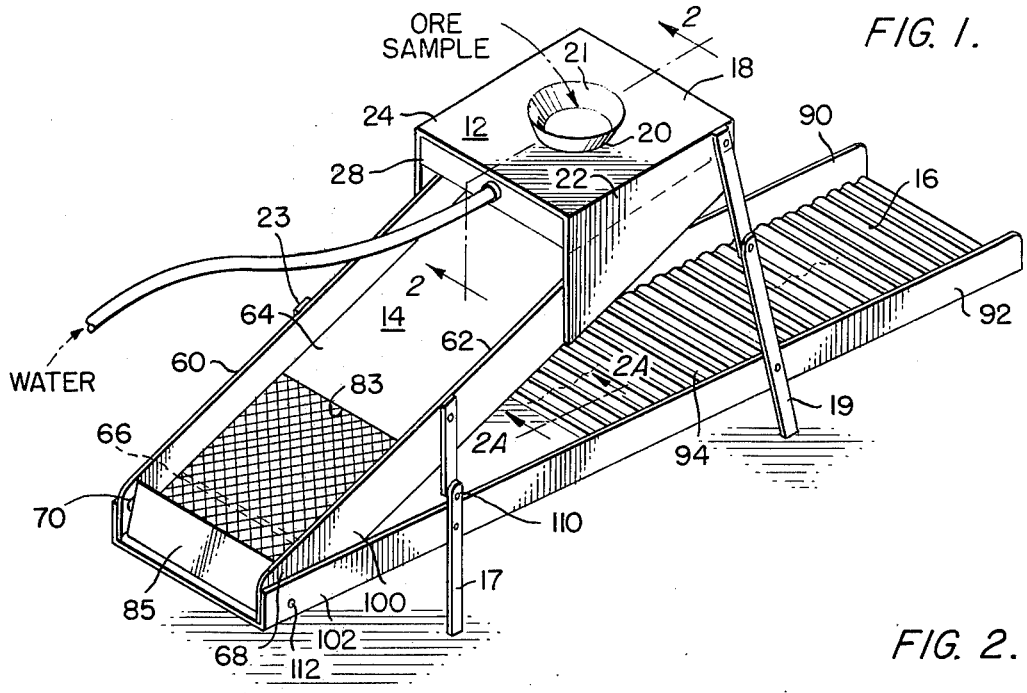
FIG. 1.
FIG. 2.
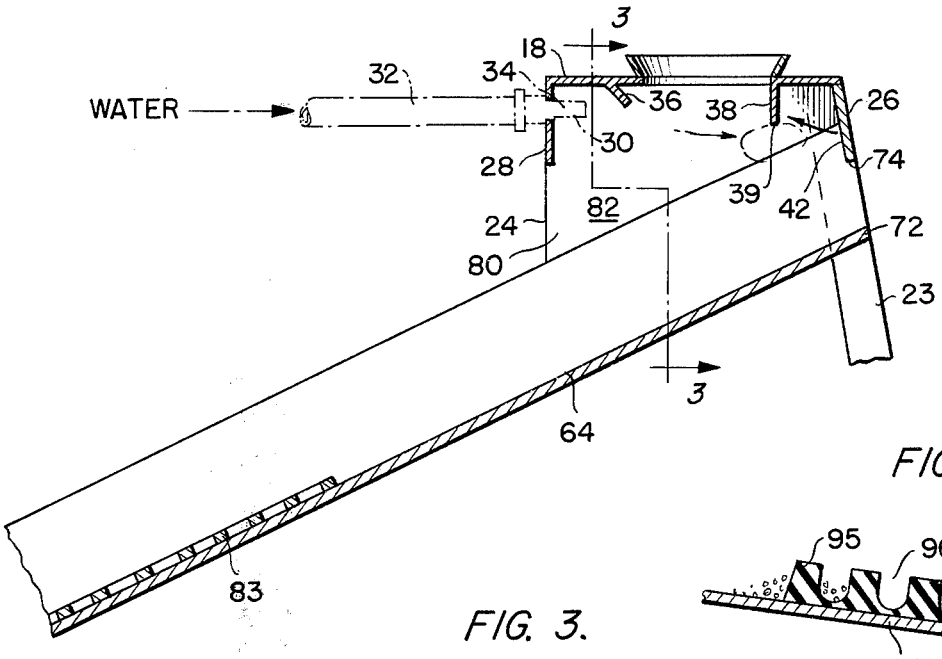
FIG. 2A.
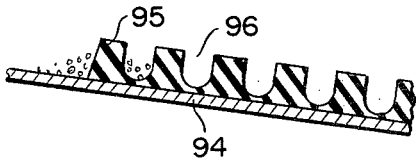
FIG. 3.
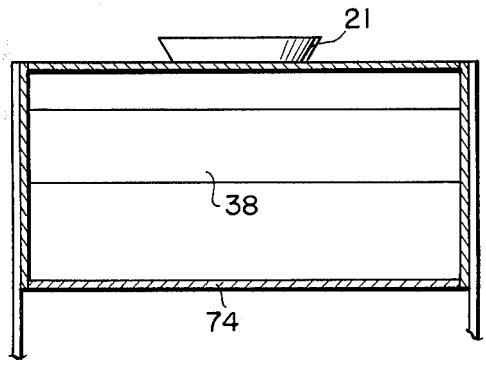

GOLD CONCENTRATOR

BACKGROUND OF THE INVENTION

1. Field of the Invention:

This invention pertains to a gold concentrator having a housing wherein sand containing gold particles is caused to be suspended in a liquid. The suspension descends through the housing onto a first sluice which has a screen near the end thereof and then onto a second sluice having a rubber mat in the bottom thereof. The rubber mat has a series of transversely extending grooves over its entire length and the grooves serve to trap the gold particles and black sand contained in the suspension.

2. Statement of the Prior Art:

The prior art discloses ore concentrator apparatus having inclined surfaces along which materials to be concentrated are directed. Transverse grooves are also shown for trapping heavy particles and lighter particles are shown to flow over the grooves and into trough for subsequent disposal. Unlike the present invention, the prior art does not show a housing positioned above a plurality of sluices wherein there occurs a suspension of sand and liquid. The prior art does not show a plurality of sluices one of which extends from the housing for carrying the suspension mixture down therealong. The second sluice intersects the first one and a grooved mat thereon serves to trap the gold particles and black sand contained in the suspension. The following list of U.S. patents are representative of the prior art devices:

| Patentee | U.S. Pat. No. | Issue Date |
|---|---|---|
| S. M. Eddy | 219,926 | Sept. 23, 1879 |
| J. McMurphy | 1,488,997 | April 1, 1924 |
| L. Hoyois | 2,184,594 | Dec. 26, 1939 |
| F. Trostler et al | 2,380,881 | July 31, 1945 |
| C. C. Tyer | 2,773,594 | Dec. 11, 1956 |
| G. T. Bolander | 2,864,501 | Dec. 16, 1958 |
| T. T. Caparrella et al | 3,232,426 | Feb. 1, 1966 |
| Leonard | 3,909,398 | Sept. 30, 1975 |
| Powers et al | 3,941,690 | Mar. 2, 1976 |
| Todd | 4,076,614 | Feb. 28, 1978 |

SUMMARY OF THE INVENTION

This invention relates to a gold concentrator which facilitates removal of gold particles and black sand from a suspension of the sand and gold particles in a liquid medium.

One object of this invention is to provide an apparatus which is simple in construction, easy to operate and easily transported in a compact condition.

It is another object of this invention to provide an apparatus which includes a housing into which sand containing gold particles is deposited. A liquid under pressure mixes with the sand and gold particles. The mixture is deflected within the housing creating a suspension of the particles within the liquid.

It is still a further object of this invention to permit the suspension to flow downwardly and rearwardly along a first sluice and over a screen which serves to retard the flow and to separate large particles from smaller ones. The suspension is turned at the bottom of the sluice and is directed downwardly along a second sluice. The second sluice has a mat therein having a series of transversely extending grooves along its entire length thereof for trapping heavy gold particles in the suspension.

It is yet another object of this invention to provide an apparatus which will be collapsible so that one sluice lies within the other.

These and other objects of this invention will become apparent from a consideration of the specification when read in conjunction with the annexed drawings.

BRIEF DESCRIPTION OF THE DRAWINGS

FIG. 1 is a perspective view of the gold concentrator showing a housing on top of a sluice, and a second sluice has a mat thereon, which has a series of transversely extending grooves therein.

FIG. 2 is a cross-sectional view taken along the line 2—2 of FIG. 1 and shows the interior of the housing into which sand and rock is deposited, and a hose attached to the housing for discharging fluid therein.

FIG. 2A shows a side view of the grooved mat.

FIG. 3 is a cross-sectional view of the housing taken along the line 3—3 of FIG. 2 and shows a depending flange within the housing which is adapted to create turbulence whereby gold particles and lighter sand particles are suspended within the fluid.

DESCRIPTION OF THE PREFERRED EMBODIMENT:

Referring in more detail to the drawings, FIG. 1 shows a gold concentrator 10 comprising a housing 12, a first sluice 14 a portion of which extends beneath the housing, a second sluice 16 is attached to but extending in the opposite direction from the first sluice, and supports 17 and 19, and 21 and 23.

The housing 12 has a top wall 18 having a large hole 20 therein a funnel 21 is secured within the hole, side walls 22 and 24 which are generally rectangular, front wall 26 and a rear wall 28. The rear wall is a flange 28 depending from the top wall 18 and secured between the side walls 22 and 24.

A nipple 30 of a hose 32 extends through an aperture 34 in the wall 28. A depending flange 36 at an angle to the nozzle extends above the nozzle and to the sides thereof and serves to spread the fluid discharging from the nozzle. A flange 38 depends from the top wall 18 on the inside thereof and is adjacent the hole 20. This flange serves to break up the water into a very fine mist.

The nozzle 30 of a water hose 32 extends through the orifice 34 and is positioned such that the water under pressure from a suitable source is discharged into the housing at an angle so that the mixture strikes the inside of wall 26 and is deflected so that the mixture returns to strike the flange 38. This results in a turbulence adjacent the bottom 39 whereby the articles of sand, gold and silver are suspended in the fluid.

The first sluice 14 is generally rectangular in configuration having side walls 60 and 62 and a bottom wall 64 which is smooth for a distance, the edge 66 of which terminates a distance from the ends 68 and 70 of the side walls 60 and 62. The opposite edge 72 of the bottom 64 terminates flush with the opposite ends of the side walls 60 and 62. As seen in FIG. 1, a portion of the first sluice 14 is positioned beneath the housing 12 and is secured by the side walls 60 and 62 to the inside surfaces 80 (one shown) of the side walls 22 and 24 of the housing. The edge 72 of the bottom 64 is spaced a distance from the bottom edge 74 of the front wall 26. When the housing 12 and the sluice 14 are thus connected, the side walls 22, 24, 60 and 62 and edges 72 and 75 define an enclosure 82 which serves to direct the suspension created within the housing onto the sluice 14. A screen 83 covers a portion of the sluice 14 near to its lower end. The screen extends to a flange 85 at the end of the sluice 14. The screen serves to retard the flow of suspension over the screen and also to separate large particles from finer ones in the suspension. The distance from edge 66 to the flange 85 defines a slot like opening through which the suspension descends onto sluice 16 after it strikes the flange.

The sluice 16 is generally rectangular in configuration and has side walls 90 and 92 and a bottom 94. The bottom 94 is partially covered with a rubber mat 95 having grooves 96 extending laterally across the width of the mat and from end to end thereof. The grooves 96 are of rounded configuration and of equal depth and serve to trap gold and heavy concentrate therein. The width of the sluice 14 is slightly smaller than the width of the sluice 16 so that the end 100 of the sluice 14 rests within the end 102 of the sluice 16.

The support struts 17 and 21 are attached to the side walls 60, 62 and 90, 92 of the sluices 14 and 16. The struts 19 and 23 are attached to the side walls 90 and 92 of the sluice 16 and to the side walls 22 and 24 of the housing 12. By this arrangement, the sluices are maintained inclined relative to each other and relative to any horizontal support surface upon which the ends of the struts are placed. The support surface should be a relatively horizontal surface such as the ground or any other type of horizontal support base. The ends of the struts extend below the sluice 16 and serves to support the entire apparatus above the ground or other base support.

In operation, the water or fluid is turned on and is injected through the nozzle 30 into the housing 12. The force of the fluid striking flange 36 causes it to stream outwardly and across the opening 20 where it mixes with sand deposited into the funnel. The mixture strikes the inside wall 42 of the housing and is deflected in a circular patterns towards the flange 38. A quantity of sand and rock is deposited into the housing 12 through the hole 20 and mixes with the water spray. The mixture of sand and water strikes the end wall 42 as above causing the mixture to be deflected within the housing. The deflected mixture swirls toward and strikes the flange 38 thus creating a suspension of the sand particles in the fluid. This feature has been determined to be advantageous because without turning the mixture of sand and fluid over within the housing, the gold particles, known as flower gold, would tend to float and flow over the grooves 96 in the mat rather than be trapped therein. The suspension of particles within the fluid medium falls through the housing 12 and onto the downwardly and rearwardly extending first sluice 14. Upon striking the smooth upper portion of the sluice 14 the suspension spreads out and flows downwardly and over the screen. The screen retards the flow permitting heavy particles to trickle slowly through the screen while the lighter particles move quickly there over. At the bottom of the first sluice the mixture flows over the edge 66 and strikes the flange 85 whereby the mixture is turned and directed in the opposite direction down the second sluice 16. The distance between the edge 66 of the bottom 64 of the sluice 14 and flange 85 defines a slot which is covered by a portion of the screen 83, through which the suspension passes to the sluice 16. The sluice 16 has a rubber mat 95 in the lower portion thereof which has a series of transversely extending grooves 96 extending from side to side and from end to end thereof with the heaviest accumulation in the first grooves. As the suspension strikes the first grooves, an agitation action takes place whereby the heavier gold and black sand is accumulated in the grooves whereas the lighter materials flow over the mat and off the end thereof. The grooves are of equal depth and when sufficient gold particles have been deposited or trapped therein, the entire apparatus is tilted so that the gold particles gravitate downwardly over the end of sluice 16. A suitable pan is employed to catch the gold particles as they gravitate from the sluice 16.

It is contemplated that the gold concentrator as described above, may be supported within a container having a source of liquid therein. A pump will be used to pump the liquid from the container into the housing 12. This construction provide an apparatus which will be compact, self-contained and operable at remote locations. Further, the apparatus as described above is collapsible for carrying in a suitcase or backpack. In this connection, the struts 17, 19, 21 and 23 are provided with hinges 110 so as to be foldable. Also, the sluices 14 and 16 are pivotably connected at their ends by pins 112 so that sluice 14 may be collapsed into the sluice 16.

While the invention has been particularly shown and described with reference to a preferred embodiment thereof, it will be understood to those skilled in the art that various changes in form and details may be made therein without departing from the spirit and scope of the invention.

What I claim is:

1. A gold concentrator comprising:

a housing for receiving sand containing gold and rock particles;

a funnel on the housing for directing sand containing large rock and gold particles into the housing;

opposed depending flanges within the housing on opposite sides of said funnel;

a first sluice extending from beneath the housing;

a screen overlying a portion of said first sluice;

a second sluice intersecting the first sluice;

a mat on the second sluice, said mat having a series of grooves therein;

a hose connected to the housing for injecting a stream of liquid therein;

said liquid stream striking said opposed depending flanges causing turbulence thereof, said turbulent stream mixing with the sand, said mixture, due to said turbulence, resulting in a suspension and separation of the particles within the liquid, said suspension gravitating downwardly onto the first sluice and over the screen at the bottom thereof then onto the second sluice whereby heavy gold particles are trapped within the grooves in the mat; and support struts for the housing and sluices.

2. A gold concentrator as defined in claim 1, wherein:

the housing is secured at one end of the first sluice, and comprises a top wall having a hole therein, side walls, front and rear walls, and said funnel is secured within said hole in said top wall.

3. A gold concentrator as defined in claim 1, wherein:

the space between said walls of said housing at the end of said first sluice defines and enclosure for directing the suspension onto the first sluice.

4. A gold concentrator as defined in claim 1, wherein:

the screen retards and serves to separate the flow of suspension because the heavier concentrates of gold particles flow more slowly thereover than the lighter particles whereby the lighter particles gravitate through said screen near the end of the first sluice in advance of the heavier particles.

5. A gold concentrator as defined in claim 1, wherein: the intersection of the first sluice and the second sluice defines a slot covered by a portion of said screen through which falls the lighter particles in advance of heavier particles onto the second sluice.

6. A gold concentrator as defined in claim 1, wherein: said mat is made of rubber and covers substantially the lower portion of said second sluice, and said grooves being of equal depth and having rounded bottoms extend from side to side and from end to end thereof.

7. A gold concentrator as defined in claim 1, wherein: the liquid strikes a deflector flange depending from said top wall rearward of said funnel spreading the liquid which mixes with sand deposited in the housing, said sand and liquid mixture strikes the inside of said front wall within the housing causing the sand and liquid to swirl together creating a suspension and separation of the sand particles in the liquid, said suspension of particles gravitating onto the upper surface of the first sluice for continued downward motion therealong.

8. A gold concentrator as defined in claim 1, wherein: said first sluice extends downwardly and rearwardly away from the housing and is pivotably attached to and within an end of said second sluice.

9. A gold concentrator as defined in claim 1, wherein: said second sluice is wider than and is beneath the first sluice and extends downwardly and oppositely therefrom and said first sluice adapted to collapse into said second sluice.

10. A gold concentrator as defined in claim 2, wherein:

said first sluice has a flange at one end thereof which serves to turn the suspension flowing down the first sluice onto the second sluice, said flange slants inwardly towards the housing.

11. A gold concentrator as defined in claim 1, wherein:

said support struts are connected to the first sluice and housing and to the second sluice such that the sluices are at an angle relative to each other and are suspended above the ground or other base.

12. A gold concentrator as defined in claim 11, and: said struts are hinged midway of their ends and the ends of the sluices are pivotably connected such that the first sluice and housing is collapsible into the second sluice.

* * * * *